US006860456B2

(12) United States Patent
Magnusson

(10) Patent No.: US 6,860,456 B2
(45) Date of Patent: Mar. 1, 2005

(54) SUSPENSION DEVICE

(75) Inventor: Reine Magnusson, Vastervik (SE)

(73) Assignee: Elfa International AG (SE)

( * ) Notice: Subject to any disclaimer, the term of this patent is extended or adjusted under 35 U.S.C. 154(b) by 0 days.

(21) Appl. No.: 10/381,722

(22) PCT Filed: Sep. 28, 2001

(86) PCT No.: PCT/SE01/02107

§ 371 (c)(1),
(2), (4) Date: Jun. 2, 2003

(87) PCT Pub. No.: WO02/26084

PCT Pub. Date: Apr. 4, 2002

(65) Prior Publication Data

US 2004/0031889 A1 Feb. 19, 2004

(30) Foreign Application Priority Data

Sep. 29, 2000 (SE) ..... 0003518

(51) Int. Cl.[7] ..... A47B 96/06

(52) U.S. Cl. ..... 248/215; 248/220.41; 248/303; 211/206

(58) Field of Search ..... 248/214, 215, 248/220.31, 220.41, 220.43, 303; 211/59.1, 191, 123, 206

(56) References Cited

U.S. PATENT DOCUMENTS 2,194,191 A * 3/1940 Wolf ..... 211/96
2,665,869 A * 1/1954 Samuels ..... 248/214
2,925,920 A * 2/1960 Skubic ..... 108/107
3,200,960 A * 8/1965 Banse ..... 206/459.5
3,486,632 A * 12/1969 Balch ..... 248/221.11
3,715,096 A 2/1973 Filbert
4,583,648 A 4/1986 Buffinton et al.
4,720,016 A * 1/1988 Kay ..... 211/96
4,936,565 A * 6/1990 Fredrickson ..... 211/59.1
5,180,068 A * 1/1993 Vargo ..... 211/191
5,303,830 A * 4/1994 Metcalf ..... 211/57.1
5,526,941 A * 6/1996 Ford ..... 211/59.1
6,530,486 B1 * 3/2003 Batting et al. ..... 211/57.1

FOREIGN PATENT DOCUMENTS

WO WO 88/06018 8/1988

* cited by examiner

*Primary Examiner*—Korie Chan
(74) *Attorney, Agent, or Firm*—Stites & Harbison PLLC; Marvin Petry

(57) ABSTRACT

A girder and a suspension device is adapted for a releasable connection thereto in order to suspend objects from the girder. The girder may be supported between two vertical rails, each having at least one slot. The girder includes a section having a web portion located in the operative state of the girder in a substantially vertical plane, and at least one flange portion angled substantially 90° thereto. The length of the flange portion substantially corresponds to the distance between the rails. The girder has an engagement element for engagement in a slot in a respective one of the rails. The web portion as well as the flange portion are provided with holes located in a common plane, perpendicular to the longitudinal direction of the girder. The suspension device includes an engagement portion dimensioned for introduction into both holes, at least a portion of the engagement portion being directed so that it tends to incline relative to the axis of the hole upon loading of the suspension device.

9 Claims, 4 Drawing Sheets

SUSPENSION DEVICE

BACKGROUND

The present invention concerns a suspension device comprising a girder and a suspension means adapted for releasable connection thereto in order to suspend objects from the girder, the girder being adapted to be supported in a substantially horizontal position between vertical rails arranged at a defined mutual distance and each having at least one slot, the girder being constituted by a section having a web portion, located in the operative state of the girder in a substantially vertical plane, and at least one flange portion angled substantially 90° thereto.

Particularly concerned is a suspension device for use in a system of vertical rails normally serving to support shelf-supporting brackets. For this purpose such rails have along their length a plurality of equally long and uniformly spaced slots, normally in two equal parallel rows. Hook-shaped protrusions of the brackets are introduced in these slots, so that the brackets are supported in a vertical as well as in a horizontal direction.

The slots may also be used for connecting other items included in the system, such as shelf-supporting shelf gables that are normally suspended from only one row of slots in each of two parallel rails.

SUMMARY OF INVENTION

The present invention aims at broadening the usefulness of a system of the kind referred to above which includes at least two rails having a plurality of equally distributed slots, by proposing a suspension device comprising on one hand a girder dimensioned to extend substantially horizontally between two substantially vertically arranged rails, is attachable to each of these rails and is provided with means for attachment of at least one suspension means, on the other hand a suspension means for co-operation with the girder.

What is particularly characterising for the invention appears from the subsequent claims.

BRIEF DESCRIPTION OF DRAWINGS

The invention will be more closely explained hereinafter reference being made to the accompanying drawings, wherein.

DETAILED DESCRIPTION

Figure 1:
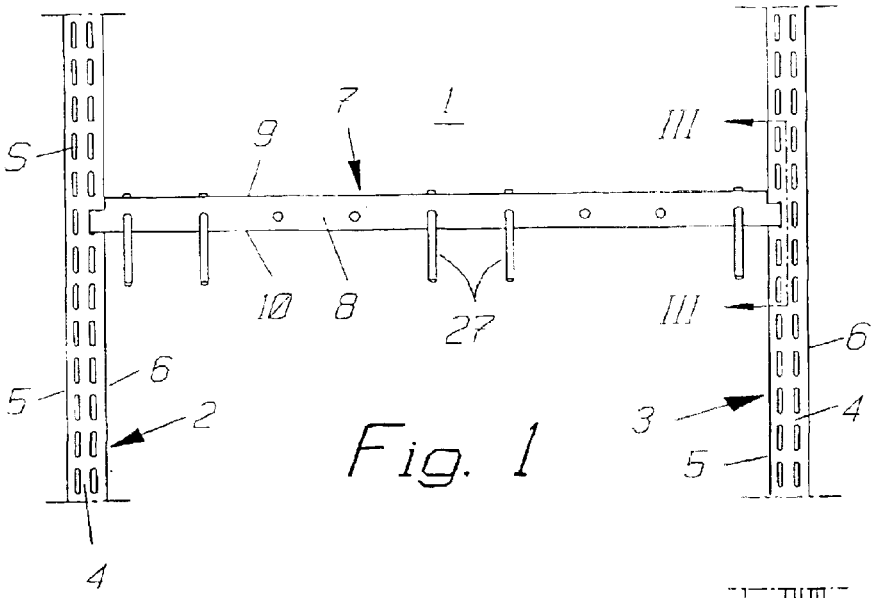
FIG. 1 is a front view of cut-off portions of two vertical rails and a girder according to the present invention suspended between them, a plurality of suspension hooks being connected to the girder.
Figure 2:
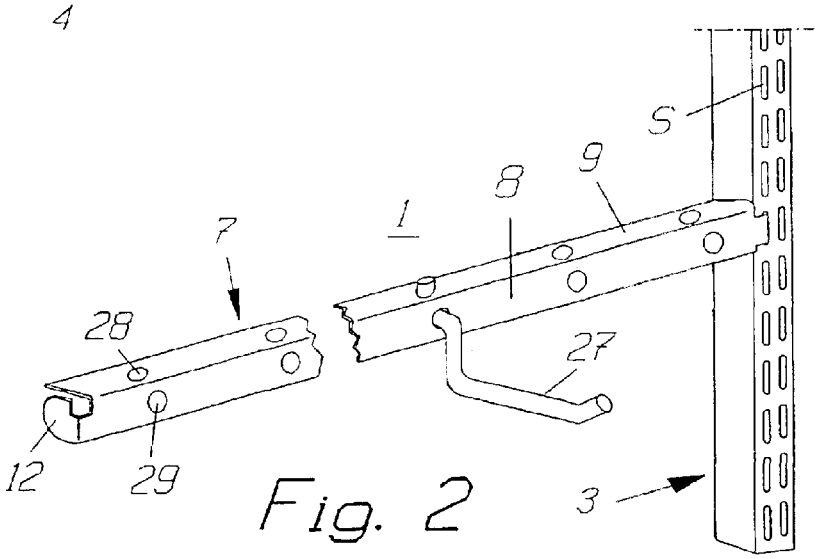
FIG. 2 is a perspective view obliquely from above of the rail and a part of the girder according to FIG. 1 with one suspension hook connected thereto.
Figure 3:
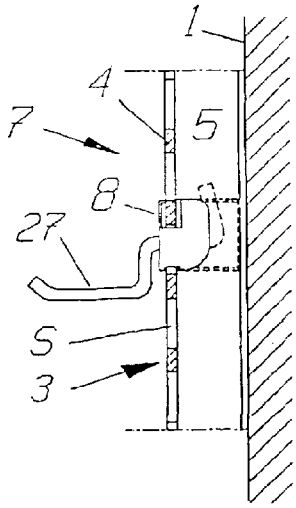
FIG. 3 is an enlarged section taken along line III—III in FIG. 2.

FIG. 1 shows two rails 2 and 3 being vertically suspended at a wall 1 at a defined mutual distance and in a manner not closer shown. Each such rail includes a web portion 4 and two flange portions 5 and 6. In the web portion 4 there is at least one row of equally long slots S having equal spacing. The girder 7 according to the present invention extends between the rails 2 and 3. The girder 7 has a web portion 8 and at least one flange portion directed substantially 90° thereto, i.e., an L-shaped cross section. It is preferred however that the girder has a substantially U-shaped cross section (FIG. 5) and that it, apart from the web portion 8, includes an upper flange portion 9 and a lower flange portion 10. The equal lengths of the flange portions define the active lengths of the girder, i.e., a length corresponding to the free distance between the rails 2 and 3. In the operative state of the girder according to FIGS. 1, 2 and 3, thus, the flange portions 9 and 10 are located between the facing flange portions 6 and 5 of the rails 2 and 3, respectively, and have their edges 9', 10', respectively, turned towards the wall 1.

Figure 11:
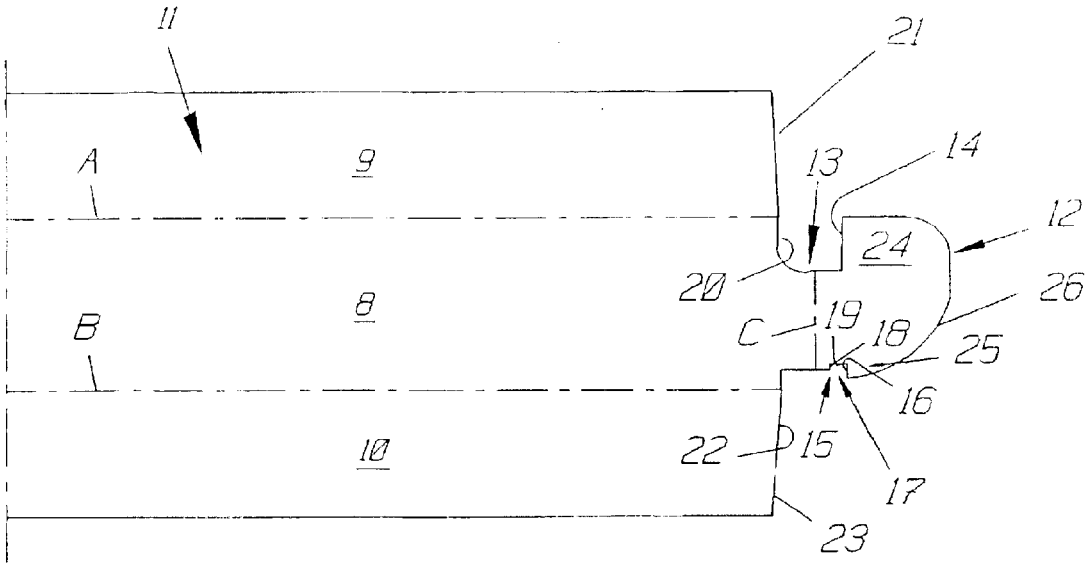
FIG. 11 shows an end portion of a blank for the manufacture of a girder according to the present invention.

In order to mount the girder 7 to two rails 2 and 3, the web portion 8 is provided at its ends with engagement means 11, 12, respectively, which may be separate pieces welded to the girder, but preferably are integrated in extensions of the web portion, the original shape of which best appears from FIG. 11 showing the right end (seen according to FIG. 1) of a blank 11 for the manufacture of a girder 7. It is realised that the left end of the blank is a mirror image of the right one. On the blank there are drawn two parallel dash dotted lines A and B, which are the bending lines along which the flange portions 9 and 10 are bent at right angles to the web portion 8.

In FIG. 11 is shown that the extension 12 substantially constitutes an extension of the web portion 8 which has been provided with one deeper upper recess 13 having a support edge 14 and one more shallow lower recess 15 having a support edge 16 aligned with the support edge 14. Additionally, the lower recess has an indentation 17 having a bottom 18 and an edge 19 opposite to the support edge 16. The distance between the edge 19 and the support edge 16, i.e., the width of the indentation 17, is somewhat larger than the thickness of the web portion 4 of the rails (see FIG. 3). The edge 20 of the web portion 8 opposite to the support edge 14 is substantially parallel with the latter up to the bending line A, from where the end edge 21 of the flange portion 9 diverges somewhat (typically 4°) from an imaginary extension of the support edge 14. In a similar manner, the edge 22 of the web portion 8 opposite to the support edge 16 is substantially parallel with the latter up to the bending line B, from where the end edge 23 of the flange portion 10 diverges somewhat (typically 4°) from an imaginary extension of the support edge 16. In the bent condition of the girder, the diverging edges 22 and 23 result in a slight wedge shape of the flange portions, as appears from FIG. 7, which facilitates the introduction of the girder between two rails 2 and 3.

Extending perpendicularly to the bending lines A and B in FIG. 11 is a bending line C parallel with the support edges 14 and 16 and the imaginary extension of which extends approximately halfway between the support edge 14 and the edge 20, and the support edge 16 and the edge 22, respectively.

Figures 4, 5, 6, 7:
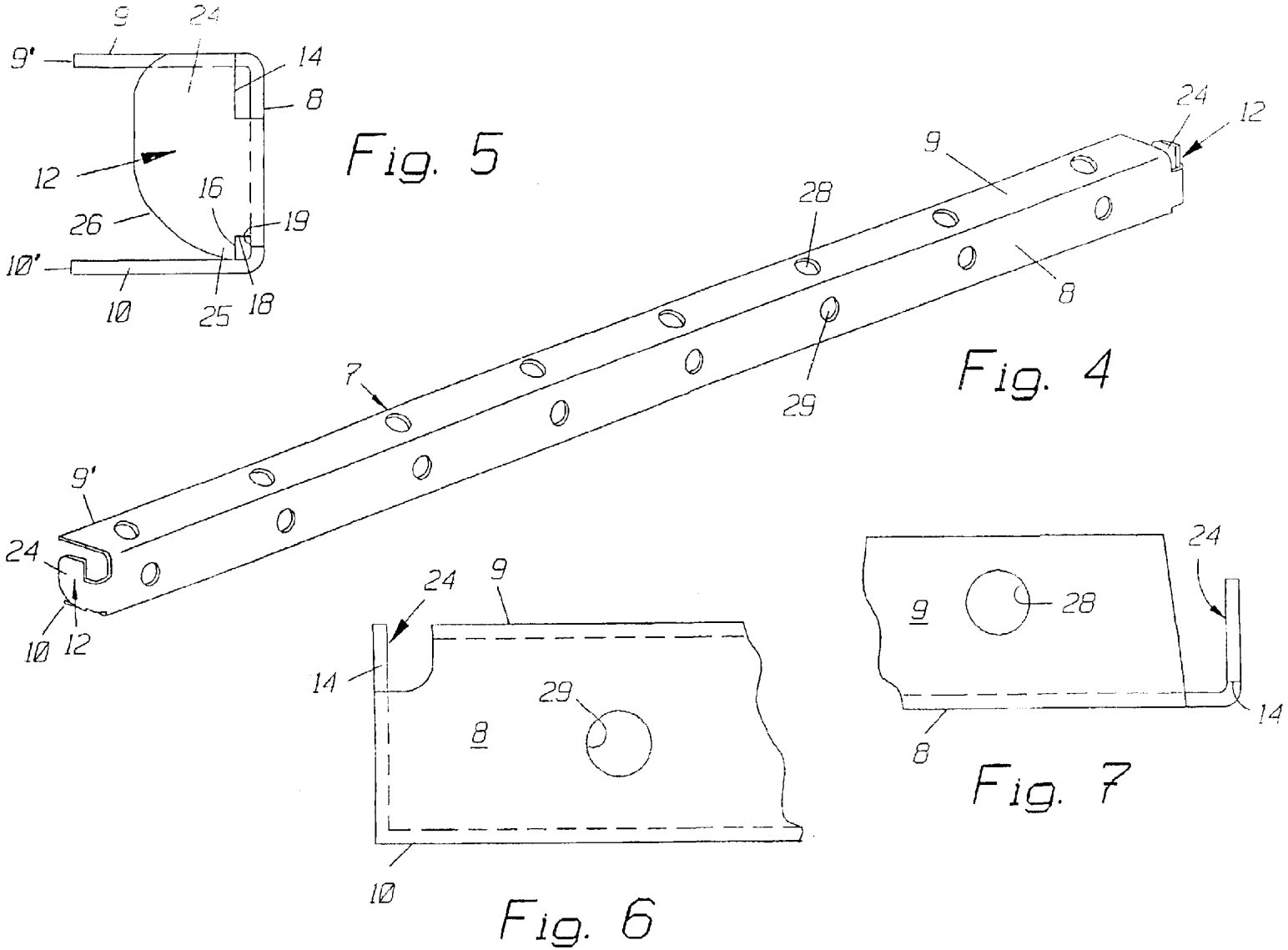
FIG. 4 is a perspective view obliquely from above of only the girder.
FIG. 5 is an enlarged end view of the left end of the girder of FIG. 4.
FIG. 6 is a side view at the same scale as FIG. 5 of the left end of the girder of FIG. 4 seen towards its web portion.
FIG. 7 is a view from above at the same scale as FIG. 5 of the right end of the girder of FIG. 4.

Bent about the respective line C, the extensions 11 and 12 obtain the shapes particularly appearing from FIGS. 4 and 5.

The upper portion of the extension 12 defined by the support edge 14 forms an upper hook portion 24, whereas its lower portion defined by the support edge 16 forms a lower hook portion 25.

When mounting the girder 7 in two rails 2 and 3, the girder is somewhat turned, i.e., rotated around its longitudinal axis, such that the upper hook portions 24 of the extensions 11 and 12 may be introduced into a slot S of each of the rails 2 and 3. Hereby, also the flange portions 9 and 10 of the girder are introduced between the facing flange portions 6 and 5, respectively, of the rails. After introduction of the hook portions 24, the girder is turned back, which is enabled due to an arcuately curved outer edge 26, such that the girder will occupy a position substantially corresponding to FIG. 3, i.e., having its web portion 8 substantially vertical and having the upper hook portions 24 engaging upwardly behind the web portions 4 of the rails and the support edges 14 supporting against the rear sides of the web portions. In this position, the girder is lowered so that its lower hook portions 25 will engage downwards behind the web portions 4 of the rails 2, 3 and the support edges 16 will support against the rear sides of the web portions 4. Finally, the bottoms 18 of the indentations 17 will support against the downwardly turned ends of the slots S and, thus, support the entire girder 7.

In order to connect suspension means, such as suspension hooks 27, to the girder, it is provided with at least two holes located in the same perpendicular plane through the girder. In the preferred embodiment shown in FIGS. 1–3, a plurality of holes 28 are arranged in the upper flange portion 9 and a corresponding number of holes 29 are arranged in the web portion 8. In these holes may be introduced a hook of rod-shaped material bent for example according to FIG. 8 and preferably having a circular cross section of, for instance, 8 mm diameter.

Apart from a suspension portion 30 directed substantially horizontally in this embodiment, the hook 27 comprises an approximately S-shaped engagement portion 31 connecting thereto. This comprises a downwardly directed connection portion 32 carrying the suspension portion 30, a substantially horizontal intermediate portion 33 and an upwardly directed locking portion 34.

Figure 8:
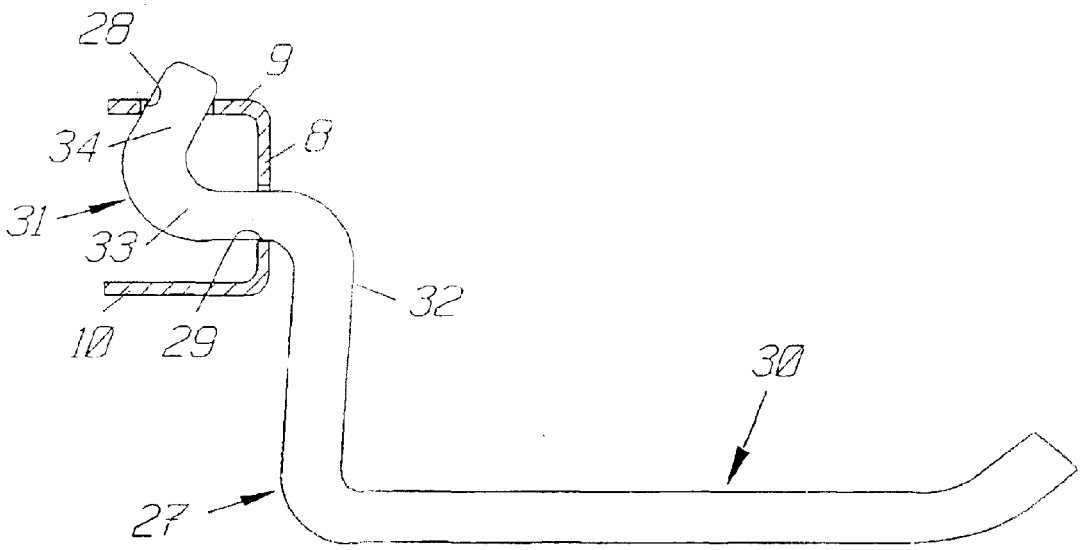
FIG. 8 is a side view of a suspension means introduced into a girder shown in section.

When mounting a suspension hook, the locking portion 34 is first introduced in an approximately horizontal direction into a hole 29 in the web portion 8 of the girder. Thereafter, the hook is turned so that the locking portion may be brought from underneath through a hole 28 in the upper flange portion 29 of the girder corresponding to the hole 29. As indicated in FIG. 8, also the intermediate portion 33 is substantially horizontal in the substantial horizontal position of the suspension portion 30. It is preferred, however, that the angles between the downwardly turned connection portions 32 and the intermediate portion 33 and the suspension portion 30, respectively, is less than 90°, preferably about 87°. It also appears, that the intermediate portion 33 extends so far into the girder, that the angle of the locking portion 34 to the intermediate portion 33 is considerably less than 90°, preferably about 70°, i.e., so that the locking portion 34 is inclined relative to the axis of the hole 28. For this reason, the hole 28 is not circular, but oval. For a hook having the exemplified cross section dimension 8 mm mentioned, the oval hole suitable has a length of 9.5 mm and a width of 8.3 mm, i.e., it is terminated by two half circles having 4.15 mm radius, while the hole 29 is circular and suitably has a diameter of about 8.5 mm.

When loading the hook 27, an upwardly turning momentum will be imparted through the connection portion 32 on the intermediate portion 33 and the locking portion 34 about the lower edge of the hole 29. The locking portion will then tend to be further introduced into the hole 28, i.e., due to its inclined position to exert an increasing wedge action against the hole 28. Thus, since the locking portion 34 will be very firmly held in the hole 28, and since the hole 29 does not allow any appreciable movement of the intermediate portion 33 neither in horizontal nor vertical direction, the suspension portion 30 of the hook will be extraordinarily stable, particularly laterally.

The turning momentum transferred to the girder 7 is transferred through the support edges 14 and the edges 19 of the end portions of the girder to the rear sides and the front sides, respectively, of the web portions of the rails 2 and 3.

Advantageously, however, the flange portions 9 and 10 are so wide, that they, in the mounted state of the girder, substantially abut the wall 1, or a corresponding surface, along which the rails 2 and 3 are arranged. Hereby, part of the turning momentum on the girder may be absorbed by the contact of the lower flange portion 10 with the wall.

Figure 9:
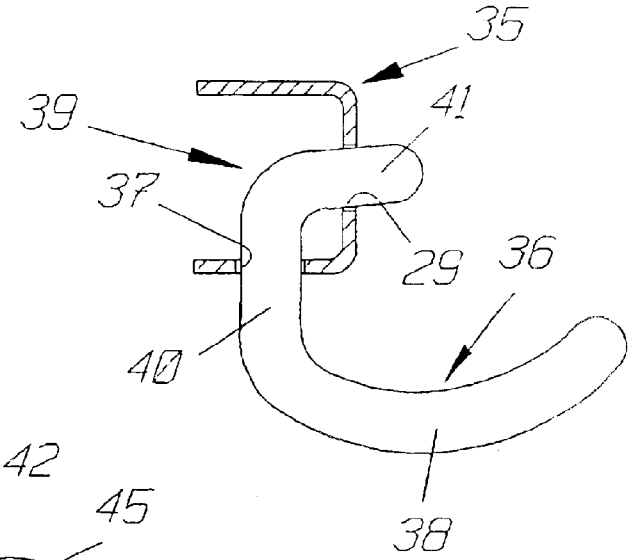
FIG. 9 is a side view of a variant of suspension means introduced into a girder shown in section and having another hole arrangement.

In FIG. 9 is shown an embodiment of a girder 25 and a suspension hook 36 where the girder, apart from a hole 29 in the web portion 8, has a hole 37 in the lower flange portion 10, and the hook 36 is adapted to be introduced from below through the hole 37 and thereafter out through the hole 29. Apart from a suspension portion 38 the hook has, connected thereto, an approximately L-shaped engagement portion 39 comprising a substantially vertical intermediate portion 40 and a substantially horizontal locking portion 41. Preferably, the locking portion does not extend axially through the hole, but forms an angle with it so that momentum on the hook results in an increased contact pressure between the locking portion 41 and the lower edge of the hole 29. The hole 29 may be circular or slightly oval.

Figure 10:
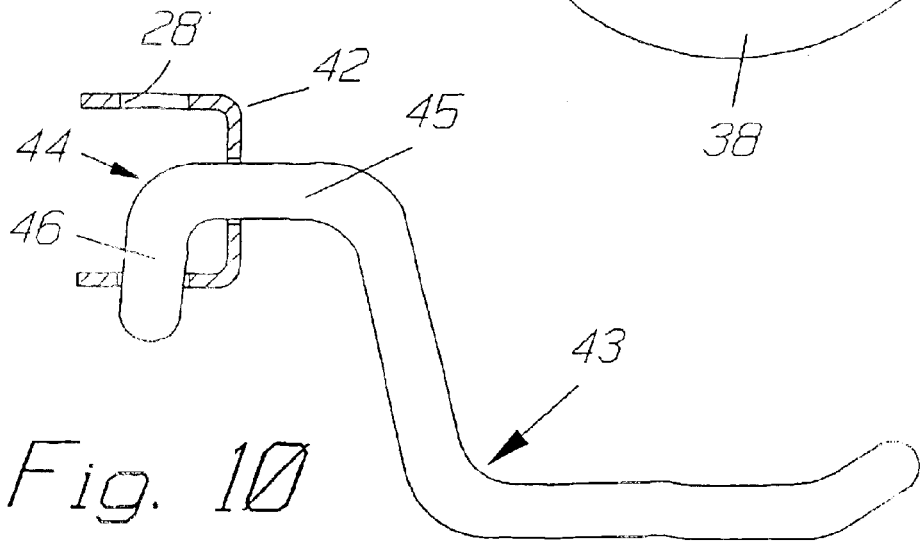
FIG. 10 is a side view of still another variant of suspension means introduced into a girder shown in section and having still another hole arrangement.

FIG. 10 shows a further embodiment, where a girder 42 is used together with a suspension hook 43 adapted to be introduced through the hole 29 and out through the hole 37 in the lower flange portion. Apart from a suspension portion 43, the hook has, connected thereto, an approximately L-shaped engagement portion 44 comprising a substantially horizontal intermediate portion 45 and a substantially vertical locking portion 46.

In FIG. 10 is also shown that a third hole 28', corresponding to the holes 28 of the first embodiment, may be arranged in the same plane as the holes 29 and 37 in order thereby to make the girder useful for all the suspension hooks here described.

Figure 12:
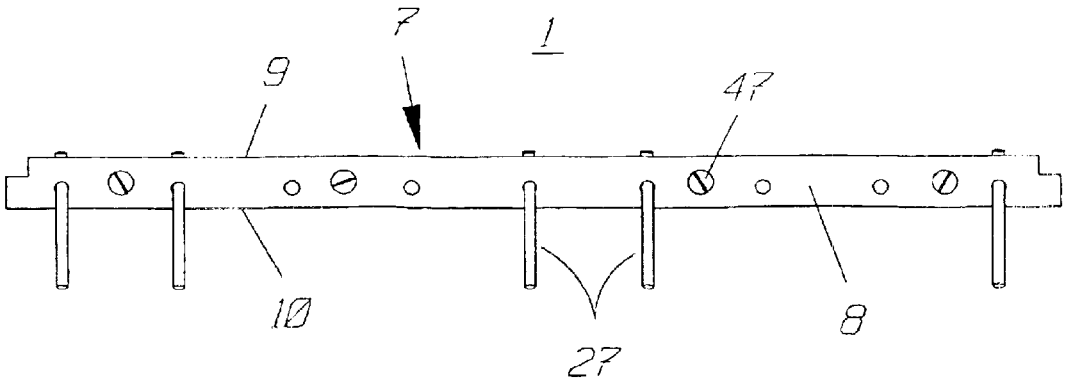
FIG. 12 is a front view of a girder provided with particular fastening holes.

The holes 29 may also be used to attach the girder, e.g., to a wall by for instance screwing screws through two or more holes 29. Also in the main application of the girder shown in FIG. 1, one or more screws may be screwed through one or more holes 29 to prevent bending of the girder upon large loads. However, in order not to have attachment elements occupying the holes 29 it is advantageous to provide particular holes for attachment elements in the web portion 8 according to FIG. 12, such as screws 47 to be screwed into the wall 1.

Here has been shown and described a circular cross section of the engagement portion of the suspension means and corresponding shapes of holes. As an alternative, it may be conceived a square cross section of the engagement portion and a square and an oblong hole with corresponding right angled ends.

Even if suspension hooks for co-operation with the girder have been shown and described, it is realised that other elements are equally possible in order to connect objects to the girder that should be supported thereby.

What is claimed is:

1. A suspension device comprising a girder and a suspension means adapted for releasable connection thereto in order to suspend objects from the girder, said girder being adapted to be supported longitudinally extending in a substantially horizontal position between vertical rails arranged at a defined free mutual distance and each of said vertical rails having a web portion and two flange portions, each web portion having at least one slot, said girder having two ends and being constituted by a section having a web portion, located in the operative state of the girder in a substantially vertical plane, and at least one girder flange portion angled substantially 90° to said girder web portion, wherein:

said girder flange portion has a length substantially corresponding to said free distance between the rails;

said girder is provided with engagement means in each of said two ends and adapted for engagement in one of said slots in a respective one of said rails, said engagement means being formed in a respective extension of said girder web portion directed substantially 90° with respect to said girder web portion;

said girder web portion and said at least one girder flange portion are provided with holes having their center located in a common plane, perpendicular to said longitudinal extension of said girder; and said suspension means includes an engagement portion dimensioned for introduction in a first of said holes and thereafter in a second of said holes, at least an upper locking portion being inclined relative to an axis of said second hole in its position introduced therein, at least upon loading of said suspension means.

2. The suspension device according to claim 1, wherein each of said extensions of said girder web portion is provided with supporting edges arranged to support against a backward side of said web portions of said rails.

3. The suspension device according to claim 1, wherein said girder flange portion is an upper flange portion.

4. The suspension device according to claim 1, wherein said girder includes an upper and a lower girder flange portion, the equal widths of which correspond to the width of said flange portions of said rails.

5. The suspension device according to claim 4, wherein said upper and said lower girder flange portions are both provided with holes.

6. The suspension device according to claim 1, wherein said engagement portion of said suspension means has a circular cross section and one of said holes has a corresponding circular shape, whereas the other of said holes has an oval shape.

7. The suspension device according to claim 3, wherein said engagement portion is approximately S-shaped having said upper locking portion engaging in an operative state from below into said second hole in said upper girder flange portion, an intermediate portion being substantially horizontal in the operative state and extending through said hole in said girder web portion, and a downwardly directed connection portion for suspended load.

8. The suspension device according to claim 7, wherein said locking portion forms an angle of about 70° with said intermediate portion and said hole in said upper girder flange portion is oval.

9. The suspension device according to claim 1, wherein particular holes for fastening elements are provided in said girder web portion.

* * * * *